US008216757B2

(12) United States Patent
Mizutani et al.

(10) Patent No.: US 8,216,757 B2
(45) Date of Patent: Jul. 10, 2012

(54) TONER FOR ELECTROSTATIC CHARGE IMAGE DEVELOPMENT AND MANUFACTURING METHOD THEREOF, AND ELECTROSTATIC CHARGE IMAGE DEVELOPER, TONER CARTRIDGE, PROCESS CARTRIDGE AND IMAGE FORMING APPARATUS

(75) Inventors: Noriyuki Mizutani, Kanagawa (JP); Shinya Nakashima, Kanagawa (JP); Takeshi Iwanaga, Kanagawa (JP); Takafumi Koide, Kanagawa (JP); Susumu Yoshino, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 997 days.

(21) Appl. No.: 12/173,412

(22) Filed: Jul. 15, 2008

(65) Prior Publication Data

US 2009/0155707 A1 Jun. 18, 2009

(30) Foreign Application Priority Data

Dec. 17, 2007 (JP) ..... 2007-324744

(51) Int. Cl.
*G03G 9/08* (2006.01)

(52) U.S. Cl. ..... 430/109.4; 430/111.4; 430/137.14; 399/111

(58) Field of Classification Search ..... 430/109.4, 430/111.4, 137.14
See application file for complete search history.

(56) References Cited

U.S. PATENT DOCUMENTS

| | | | | |
|---|---|---|---|---|
| 5,346,797 | A | 9/1994 | Kmiecik-Lawrynowicz et al. | |
| 2006/0057486 | A1* | 3/2006 | Moriyama et al. | 430/109.4 |
| 2007/0184377 | A1* | 8/2007 | Shu et al. | 430/109.4 |
| 2008/0095553 | A1 | 4/2008 | Tanaka et al. | |
| 2008/0187854 | A1* | 8/2008 | Yoshida et al. | 430/109.4 |

FOREIGN PATENT DOCUMENTS

| | | |
|---|---|---|
| CN | 101061441 A | 10/2007 |
| JP | A-63-282752 | 11/1988 |
| JP | A-06-250439 | 9/1994 |
| JP | A-2003 -084493 | 3/2003 |
| JP | A-2004-151709 | 5/2004 |
| JP | A-2005-308891 | 11/2005 |
| JP | A-2007-279653 | 10/2007 |

OTHER PUBLICATIONS

Jul. 29, 2011 Chinese Office Action issued in Chinese Patent Application No. 200810131383.0 (with translation).

* cited by examiner

*Primary Examiner* — Christopher Rodee
(74) *Attorney, Agent, or Firm* — Oliff & Berridge, PLC

(57) ABSTRACT

There is provided a toner for electrostatic charge image development, which includes a binder resin that includes a non-crystalline polyester resin and a crystalline polyester resin, and a colorant, wherein in a measurement of an acetone-soluble fraction of the toner by gel permeation chromatography, in which W1 represents the total area of an elution curve of the acetone-soluble fraction, F(0-10) represents an eluate corresponding to from the beginning of the elution to 10% elution of W1 over time, and F(80-100) represents an eluate corresponding to from 80% elution to 100% elution of W1 over time, the amount of an aliphatic unsaturated dicarboxylic acid-derived component of the resins contained in the eluate F(0-10) is in the range of from about 0 mol % to about 10 mol % relative to the total amount of the acid-derived components of the resins contained in the eluate F(0-10), and the amount of the aliphatic unsaturated dicarboxylic acid-derived component of the resins contained in the eluate F(80-100) is in the range of from about 20 mol % to about 60 mol % relative to the total amount of the acid-derived components of the resins contained in the eluate F(80-100).

15 Claims, 2 Drawing Sheets

TONER FOR ELECTROSTATIC CHARGE IMAGE DEVELOPMENT AND MANUFACTURING METHOD THEREOF, AND ELECTROSTATIC CHARGE IMAGE DEVELOPER, TONER CARTRIDGE, PROCESS CARTRIDGE AND IMAGE FORMING APPARATUS

CROSS-REFERENCE TO RELATED APPLICATIONS

This application is based on and claims priority under 35 USC 119 from Japanese Patent Application No. 2007-324744 filed Dec. 17, 2007.

BACKGROUND

1. Technical Field

The present invention relates to a toner for developing an electrostatic charge image and a method for manufacturing the same, and an electrostatic charge image developer, a process cartridge and an image forming apparatus.

2. Related Art

Many methods for electrophotography are known. Generally, a latent image is formed, using various methods, on a photoreceptor (image holding member) using a photoconductive substance, the formed latent image is developed using a toner for electrostatic charge image development (hereinafter, sometimes referred to as "toner") to form a toner image, then the toner image on the photoreceptor surface is transferred to a surface of a transfer body such as paper optionally using an intermediate transfer body, and the transferred image is pressurized, or heated and pressurized, to fix the toner image, or the transferred image is fixed by solvent evaporation, thereby forming the fixed image. The toner remaining on the photoreceptor surface is usually cleaned by various methods, as necessary, before being subjected again to the above processes.

As a fixing technique for fixing a transfer image which has been transferred onto the surface of a transfer body, a heat roll fixing method is generally known, wherein a transfer body, onto which a toner image has been transferred, is inserted between a pair of rolls including a heat roll and a pressure roll followed by fixing the toner image. Further, as a similar technique, a fixing method in which one or both of the rolls is replaced with a belt is also known. In these techniques, compared to other fixing methods, a fixed image is obtained quickly, and energy efficiency is high, and moreover, there is less damage to the environment by volatilization of a solvent or the like.

In the above toner obtained by the aggregation and coalescing method, it is known that good image formation is attainable by lowering the fixing temperature of the toner using a binder resin containing a crystalline resin and a non-crystalline resin.

However, in the production of the toner containing a crystalline polyester resin by the above aggregation/coalescing method, since the resin particles in a crystalline polyester resin dispersion readily aggregate compared to a non-crystal line polyester resin dispersion, the crystalline polyester resin readily aggregates by itself at an early stage when forming aggregated particles in the production of the toner, and, as a result, toner particles having an uneven composition (that is, having a phase separated structure in the order of several tens of nm to several hundreds of nm) are readily formed.

The unevenness in the toner composition entails broader toner charge distribution, and as a result, the charge distribution is magnified and fog worsens, and problems such as staining in a machine due to the generation of a toner cloud frequently occur. In particular, under a high temperature and high humidity environment, the influence of the unevenness of the toner composition becomes remarkable.

SUMMARY

According to an aspect of the invention, there is provided a toner for electrostatic charge image development, including, a binder resin that includes a non-crystalline polyester resin and a crystalline polyester resin, and a colorant, wherein in a measurement of an acetone-soluble fraction of the toner by gel permeation chromatography in which W1 represents the total area of an elution curve of the acetone-soluble fraction, F(0-10) represents an eluate corresponding to from the beginning of the elution to 10% elution of W1 over time, and F(80-100) represents an eluate corresponding to from 80% elution to 100% elution of W1 over time, the amount of an aliphatic unsaturated dicarboxylic acid-derived component of the resins contained in the eluate F(0-10) is in the range of from about 0 mol % to about 10 mol % relative to the total amount of the acid-derived components of the resins contained in the eluate F(0-10), and the amount of the aliphatic unsaturated dicarboxylic acid-derived component of the resins contained in the eluate F(80-100) is in the range of from about 20 mol % to about 60 mol % relative to tine total amount of the acid-derived components of the resins contained in the eluate F(80-100).

BRIEF DESCRIPTION OF THE DRAWINGS

Exemplary embodiment(s) of the present invention will be described in detail based on the following figures, wherein.

DETAILED DESCRIPTION

Figure 1:
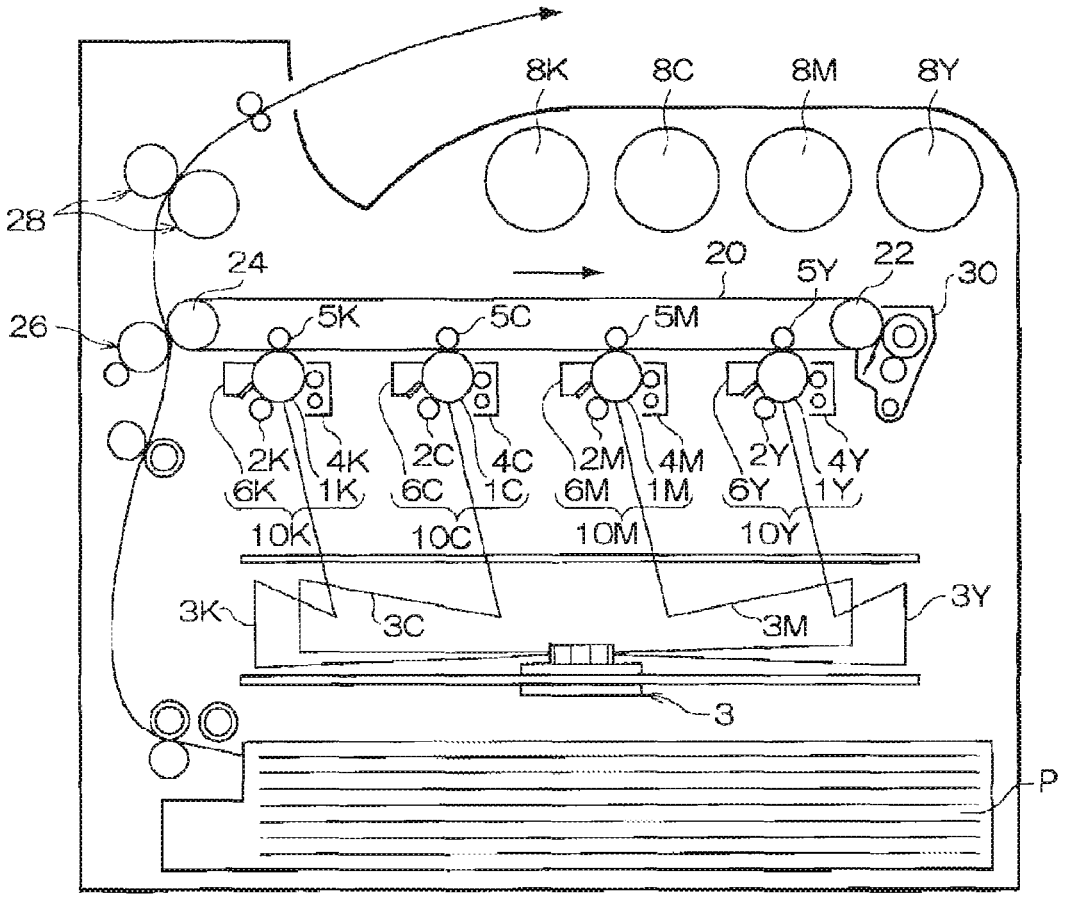
FIG. 1 is a schematic block diagram showing an example of an image forming apparatus of an exemplary embodiment of the invention.

The present invention still be illustrated in more detail by the exemplary embodiments shown below.

<Electrostatic Charge Image Developing Toner>

The toner for electrostatic charge image development of an exemplary embodiment contains a binder resin which includes a non-crystalline polyester resin and a crystalline polyester resin (hereinafter, each is simply referred to as "non-crystalline resin" and "crystalline resin", respectively in some cases) and a colorant. In a measurement of an acetone-soluble fraction of the toner by gel permeation chromatography, in which W1 represents the total area of an elution curve of the acetone-soluble fraction, F(0-10) represents an eluate corresponding to from the beginning of the elution to 10% elution of W1 over time and F(80-100) represents an eluate corresponding to from 80% elution to 100% elution of W1 over time, the amount of an aliphatic unsaturated dicarboxylic acid-derived component of the resins contained in the eluate F(0-10) is in the range of from 0 mol % or about 0 mol % to 10 mol % or about 10 mol % relative to the total amount of the acid-derived components of the resins contained in the eluate F(0-10), and the amount of the aliphatic unsaturated dicarboxylic acid-derived component of the resins contained in the eluate F(80-100) is in the range of from 20 mol % or about 20 mol % to 60 mol % or about 60 mol % relative to the total amount of the acid-derived components of the resins contained in the eluate F(80-100).

For low temperature fixing of a toner, a crystalline polyester resin may be used as a binder resin. However, since the crystalline polyester resin tends to have inherently a lower miscibility with a non-crystalline resin, a phase separated structure is easily caused between the crystalline polyester resin and the non-crystalline polyester resin when both are used in the production of the toner, thus resulting in difficulty to obtain a toner having an acceptable evenness (the state where the phase separation is not observed).

In the production of a toner by the emulsion aggregation for especially aiming at small size diameter and spherical shape, as mentioned above, the crystalline polyester resin particles themselves tend to be previously aggregated each other, thereby to easily form toner particles with uneven composition.

For this reason, since the surface of the toner tends to become uneven and the toner charge distribution is more broadened as compared to the toner particles produced from the non-crystalline resin alone, this caused easily the image fogging and staining inside the apparatus.

On the other hand, when miscibility between the crystalline resins and the non-crystalline resins is made to be enhanced, although uniformity on the surface of the toner particles and broadening of the width in the toner charge distribution become good, the glass transition temperature of the non-crystalline resin falls due to mutually dissolving with the crystalline resin, thereby easily causing adherence (blocking) of the toners.

The low temperature fixing refers to a fixation of the toners under heating at about 120° C. or less. The "crystalline polyester resin" refers to a resin that shows a distinct endothermic peak, not a stepwise change in the endothermic caloric value in differential scanning calorimetry (DSC). On the hand, the resin that shows a stepwise change in the endothermic calorie value in DSC means a non-crystalline resin (amorphous polymer).

Therefore, regarding to the above problem in the production of the toner by the emulsion aggregation method using the crystalline polyester resin and the non-crystalline polyester resin, it is desirable that the aggregation of the resin particles at the initial stage is regulated and the aggregated particles finally formed have a structure wherein the resin composition was varied at the inside and the outside.

As the result of investigation by the inventors, it was found that in the toner containing the crystalline polyester resin, by using a crystalline polyester resin and a non-crystalline polyester resin having a molecular weight different from that of the crystalline polyester resin and a specific structure, it is possible to form toner particles having a sufficient uniform composition.

That is, by using a low molecular weight non-crystalline polyester resin having a high affinity to the crystalline polyester resin in the aggregation process, it is possible to cause such non-crystalline polyester resin to be mutually dissolved with the crystalline polyester resin which is readily aggregated solely at the initial stage of the aggregation process, to form pseudo composite particles, and after that, by aggregating and coalescing the particles, it is possible to suppress the aggregation of the crystalline polyester resin alone, thereby enabling to uniform the composition of the toner particles sufficiently. In the above composite particles, the crystalline polyester particles and the non-crystalline polyester particles do not need to be mixed completely to become one particle, and two or more particles may contact physically and a part of the two particles may be in a mixed state.

On the other hand, in the composite particles of the crystalline polyester resin and the non-crystalline polyester resin, since both are mutually dissolved, the mechanical strength and glass transition temperature (Tg) is lower than those of the intact non-crystalline polyester resin, and therefore resulting toner may have insufficient strength, resulting in easy occurrence of filming, or blocking inside a development apparatus or a toner cartridge etc.

In an exemplary embodiment, the above problem may be avoided by further using a high molecular weight non-crystalline polyester resin in the aggregation process.

Although, detailed mechanism is not clear, it could be considered that if the particles of the a high molecular weight non-crystalline polyester resin are present together with the composite particles which is in a state that crystalline polyester resin and the low molecular weight polyester resin are mutually dissolved, such composite particles may be bonded to, like an adhesive, the particles of the a high molecular weight non-crystalline polyester resin so that the high molecular weight non-crystalline polyester resin form an aggregate so as to include the composite particles therein, resulting in the formation of a shell structure. These aggregated particles are coalesced so that the surface of the toner is covered with the high molecular weight non-crystalline polyester resin, and blocking and filming at the time of application of heating stress may be suppressed. In this manner, a toner having a uniform composition and a sufficient strength could be obtained.

Details of the "high molecular weight" and the "low molecular weight" will be mentioned later.

In order to produce a toner of an exemplary embodiment, as mentioned later, a method in which a high molecular weight component of the non-crystalline polyester resin and a low molecular weight component of the non-crystalline polyester resin are each independently obtained by polymerization and the resulting resin particle dispersions are mixed with a crystalline polyester resin in the aggregation process is employed. However, the structure of the toner particles obtained by coalescing is such that the interior thereof is in a state that the crystalline resin and the non-crystalline resin are mutually dissolved and the exterior thereof is covered with the high molecular weight non-crystalline resin. In practice, such a structure is considerably complicated and its identification is not easy, too.

The inventors have found that t is possible to identify the toner having the above features or to control the structure, by investigating the amount of dicarboxylic acid components having a specific structure, contained in a resin component separated from a toner, by using a gel permeation chromatography (GPC) used for the determination of a molecular weight of resins.

Specifically, an acetone-soluble fraction of the toner is subjected to GPC measurement under the conditions as mentioned later, and eluates separated through the column are collected. When W1 represent the total area of an elution curve of the acetone-soluble fraction, F(0-10) represents an eluate corresponding to from the beginning of the elution 10% elution of W1 over time, and F(80-100) represents an eluate corresponding to from 80%, elution of W1 to 100% elution of W1 over, the amount of an aliphatic unsaturated dicarboxylic acid-derived component of the resins contained in the eluate (F0-10) is in the range of from 0 mol % or 0 mol % to 10 mol % or 10 mol % relative to the total amount of acid derived components of the resins contained in the eluate F(0-10), and the amount of the aliphatic unsaturated dicarboxylic acid-derived component of the resins contained in the eluate F(80-100) is in the range of 20 mol % or about 20 mol % to 60 mol % or about 60 mol % relative to the total amount of the acid-derived components of the resins contained in the eluate F(80-100).

In an exemplary embodiment, since the acetone-soluble fraction of the toner is measured, the resin contained in the eluates F(0-10) and F(80-100) is almost a non-crystalline resin. The "acid derived component" refers, as mentioned later, to a constituent moiety which was an acid component prior to the synthesis of the polyester resin, and the same is also applied to the amount of the aliphatic unsaturated dicarboxylic acid-derived component.

In this case, the resin contained in the eluate F(0-10) is a high molecular weight component in the binder resin, and the resin contained in the eluate F(80-100) is a low molecular weight component in the binder resin.

Accordingly, since the low molecular weight component contained in the eluate F(80-100) is first subjected to composite particle formation with the crystalline polyester resin at the initial stage of the aggregation, it is necessary for such a low molecular weight component to have a high affinity to the crystalline resin, and thus the aliphatic unsaturated dicarboxylic acid-derived component is contained in 20 mol % to 60 mol % based on the total amount of the acid-derived components.

As for the miscibility between resins, a solubility parameter (SP value) according to the Fedors method may be used in many cases. The SP value is an index calculated from the evaporation energy or the molar volumes of atoms or atomic groups, and is considered to be an index showing the easiness in miscibility between the resins. However, in the composite particles of an exemplary, embodiment, the crystalline polyester resin and the non-crystalline polyester resin do not reed to be mixed completely, and a part of each of both resin particles may be physically admixed together. For this reason, it is not necessarily needed for the SP values of both resins to become closer each other for the affinity, and the miscibility in limited time at the early period of the aggregation process rather becomes to require a high affinity structurally.

The inventors paid attention to the structure to raise the above affinity, in particular, the structure of a acid component used for the production of polyester resins, and examined it. As a result, it was found that a composite is easily formed because an aliphatic unsaturated dicarboxylic acid takes a planar structure of the double bond and especially has a high affinity structurally to a crystalline polyester resin with a high linearity.

If an aliphatic unsaturated dicarboxylic acid-derived component is less than 20 mol % relative to the total amount of the acid-derived components, affinity to the crystalline polyester resin may become insufficient and formation of a composite particle may become insufficient and thus it impossible to make a toner composition uniform. Conversely; if it is in more than 60 mol %, a fall of Tg of the non-crystalline resin may be caused and formation of the toner of uniform composition may become impossible after all because the non-crystalline resin per se may easily form an aggregate easily.

The amount of the aliphatic unsaturated dicarboxylic acid-derived component is preferably 20 mol % or about 20 mol % to 50 mol % or about 50 mol %, more preferably 20 mol % or about 20 mol % to 45 mol % or about 45 mol %.

On the other hand, the high molecular weight resin component contained in the eluate F(0-10) is, as mentioned above, expected to have a pseudo shell effect (effect of outer shell formation). For this reason, it is necessary that the affinity to the crystalline polyester resin be low, and it is said that contrary to the low molecular weight resin component contained in the eluate F(80-100), in the high molecular weight resin component contained in the eluate F(0-10), the content of an aliphatic unsaturated dicarboxylic acid derived component is in the range of 0 mol % or about 0 mol % to 10 mol % or about 10 mol % relative to the total amount of the acid-derived components.

If the amount of the aliphatic unsaturated dicarboxylic acid-derived component is more than 10 mol %, the affinity to the crystalline polyester resin may be increased so that the shell effect may not be obtained, causing a problem of blocking occurrence. Moreover, in an exemplary embodiment, the amount of the aliphatic unsaturated dicarboxylic acid-derived component in the high molecular weight resin component may be 0 mol % so long as other physical properties such as Tg and melting temperature (Tm) fall within the range suited for toner use, and 1 mol % or more is 5, however, desirable.

The content of the aliphatic unsaturated dicarboxylic acid-derived component is desirably 9 mol % or less or about 9 mol % or less and more desirably 8 mol % or less or about 8 mol % or less.

Analytical methods of each of the above components will be specifically described in the following.

The amount of the aliphatic unsaturated dicarboxylic acid-derived component relative to the total acid-derived components in the high molecular weight resin component and that in the low molecular resin component may be calculated if the kind of the monomers that constitute the separated resin and the ratio thereof are specified. Therefore, as mentioned above, a mixture including a high molecular weight resin and a low molecular weight resin is separated by GPC, and each component separated is analyzed by the following analysis technique to calculate the amount of each component.

Namely, in the GPC measurement using THF (tetrahydrofuran) as a mobile phase, eluates are collected by a fraction collector or the like, and fractions corresponding to a desired molecular weight part among the total area W1 in the elution curve are combined. The combined eluates are concentrated by an evaporator and dried, and the solid part is dissolved in a deuterated solvent such as deuterated chloroform or deuterated THF. $^1$H-NMR measurement is carried out, and the constituent monomer ratio of the resin in the eluate components is calculated from integral ratios of each element.

At this time, if, for example, a specific aliphatic unsaturated dicarboxylic acid is fumaric acid, the peak of the proton bonded to the unsaturated carbon atom appears at about 6.8 ppm (±0.15 ppm, hereinafter the same). The content of fumaric acid derived component may be calculated from the ratio of the integrated value of this peak and the integral value of the peak of other acid derived components. The details will be mentioned later.

Further, in the case where the kind of the constituent monomer is unknown, other technique includes concentrating the eluate, hydrolyzing the concentrate with sodium hydroxide, and analyzing the degraded product qualitatively and quantitatively by high performance liquid chromatography (HPLC), thereby to calculate the kind and the ratio of the constituent monomers.

Moreover, regarding to the molecular weight of the resin (high molecular weight component, low molecular weight component) contained in the eluate F(0-10) and F(80-100) of GPC, the weight average molecular weight of the resin contained in the eluate F(0-10) is, although it is not to generally say because the molecular weight of the binder resin is different depending on the toner, preferably in the range of 25000 to 100000, and more preferably in the range of 30000 to 70000. In addition, the molecular weight of the resin contained in the eluate F(80-100) is preferably within the range of 8000 to 20000, more preferably within the range of 10000 to 20000.

As mentioned above, since the resin component in the toner is extracted as an acetone-soluble fraction in an exemplary embodiment, a large proportion of the resins contained in the eluate F(0-10) and F(80-100) is the non-crystalline polyester resin, even if the resin contained in the toner is a mixture of the crystalline polyester resin and the non-crystalline polyester resin. Accordingly, if the kind and the ratio of the monomer that constitute the resin in the eluate are determined, the obtained values are respectively the component ratios in the high molecular weight component and the low molecular weight component of the non-crystalline resin in the binder resin of the toner.

Hereinafter, the constitution of the toner for electrostatic charge image development in an exemplary embodiment will be illustrated in detail.

The toner of an exemplary embodiment contains a binder resin that contains a non-crystalline polyester resin and a crystalline polyester resin, and a colorant.

(Crystalline Polyester Resin)

In the toner of the exemplary embodiment, low temperature fixing is realized by containing the crystalline polyester resin.

In an exemplary embodiment, the crystalline polyester resin means a resin that shows a distinct endothermic peak, not a stepwise change in the endothermic caloric value thereof in differential scanning calorimetry (DSC) as mentioned above. A copolymer in which other ingredients are copolymerized to the main chain of a crystalline polyester resin is also referred to as a crystalline resin, if the content of other ingredients is 50 constituent mole % or less. Namely, those showing an endothermic peak are included in the crystalline polyester resin. Examples of the crystalline polyester resin are given below, and are however not limitative thereto.

In the crystalline polyester resin examples of the acid which is to be the above acid-derived constituent component include various dicarboxylic acids. Among them, an aliphatic dicarboxylic acid and an aromatic dicarboxylic acid are preferable, and, in particular, a straight chain-type carboxylic acid is desirable as the aliphatic dicarboxylic acid. The dicarboxylic acid as the acid-derived component is not limited to one kind, and two or more kinds of the dicarboxylic acid-derived components may be contained. The dicarboxylic acid may include a sulfonic acid group in order to improve emulsifiability in an emulsification and aggregation process.

The "acid-derived component" refers to a constituent moiety which was the acid component before the synthesis of the polyester resin and the "alcohol-derived component" refers to a constituent moiety which was the alcohol component before the synthesis of the polyester resin.

Examples of the aliphatic dicarboxylic acid include, for example, oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid, or lower alkyl esters and acid anhydrides thereof. However, the aliphatic dicarboxylic acid is not limited to these. Among them, if availability is taken into account, adipic acid, sebacic acid, 1,10-decanedicarboxylic acid, and 1,12-dodecanedicarboxylic acid are preferable.

An aromatic dicarboxylic acid may be added to the aliphatic dicarboxylic acid, and examples of the aromatic dicarboxylic acid include terephthalic acid, isophthalic acid, orthophthalic acid, t-butylisophthalic acid, 2,6-naphthalenedicarboxylic acid, 4,4'-biphenyldicarboxylic acid, and the like. Among them, terephthalic acid, isophthalic acid, and t-butylisophthalic acid are preferable in view of availability and easy emulsification. As for the addition amount of these aromatic dicarboxylic acids, it is preferably 20 constituent moles or less, more preferably 10 constituent mole % or less, and still more preferably 5 constituent mole % or less. If the addition amount of the aromatic dicarboxylic acid is more than 20 constituent moles, there are cases where emulsification may become difficult, or where crystallinity may be inhibited so that an image luster peculiar to the crystalline polyester resin may not be obtained, or further where a melting point depression may be caused and the storability of the image may also worsen.

In the crystalline polyester resin, the alcohol for an alcohol-derived component may be an aliphatic diol, and specific examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,20-eicosanediol, and the like. However, the aliphatic diol is not limited to these. Among them, when availability is taken into consideration, ethylene glycol, 1,4-butanediol, 1,6-hexanediol, 1,9-nonanediol, and 1,10-decanediol are preferable.

In the above alcohol-derived component, the content of the aliphatic diol-derived component is preferably 80 constituent mole % or more, and more preferably 90 constituent mole % or more. The alcohol-derived component includes other components as necessary. If the content of the above aliphatic diol-derived component is less than 80 constituent mole %, the crystallinity of the polyester resin may lower, and thus the melting point may drop. As a result, the toner blocking resistance, the image storability, and the low temperature fixability may be deteriorated.

The other components which may be included as necessary are constituent components such as a diol-derived component having a double bond(s), a diol-derived component having a sulfonic acid group(s), and the like. Examples of the above diol having a double bond(s) include 2-butene-1,4-diol, 3-butene-1,6-diol, 4-butene-1,8-diol, and the like. The content of the diol-derived component having a double bond(s) is preferably 20 constituent mole % or less and is more preferably from 2 to 10 constituent mole %, relative to the total alcohol-derived components. If the content of the diol-derived component having a double bond(s) is more than 20 constituent mole %, the crystallinity of the polyester resin may lower or the melting point may drop, and therefore the storability of an image may be deteriorated.

As the crystalline polyester resin in an exemplary embodiment, aliphatic crystalline polyester resins are preferable. The constituent ratio of the aliphatic polymerizable monomer that is a constituent component of the aliphatic crystalline polyester resin is preferably 60 mol % or more, and more preferably 90 mol % or more. As the aliphatic polymerizable monomer, the above-described aliphatic diols or dicarboxylic acids may be preferably used.

In this case, an aliphatic crystalline polyester resin obtained by reacting a dicarboxylic acid having 10 to 12 carbon atoms with a diol having 4 to 9 carbon atoms is preferable. By making the carbon number within this range, a crystalline polyester resin which has a melting temperature suitable for a toner may be easily obtained, and the linearity of the resin structure will increase, and therefore an affinity to non-crystalline polyester resins may increase because the polyester is aliphatic.

The number of the carbon atoms of the dicarboxylic acid is more preferably within the range of 10 to 12, and the number of the carbon atoms of the diol is more preferably within the range of 6 to 9.

The above crystalline polyester resin may be manufactured at a polymerization temperature of between 180° C. and 230° C. Pressure within the reaction system is reduced as necessary, and the reaction is carried out while removing water or alcohol which is generated at the time of condensation.

If the polymerizable monomer does not dissolve or is not miscible at the reaction temperature, a high boiling point solvent may be added thereto as a solubilizer to dissolve the monomer. The polycondensation reaction is effected while the solubilizer is removed by distillation. If a poorly miscible monomer is present in the copolymerization reaction, the poorly miscible polymerizable monomer is subjected to condensation beforehand with an acid or alcohol which is scheduled for polycondensation, and then the condensed product is subjected to polycondensation with the main component.

Catalysts that may be used in the manufacturing of the crystalline polyester resin include alkali metal compounds such as sodium and lithium; alkaline earth metal compounds such as magnesium and calcium; metallic compounds such as zinc, manganese, antimony, titanium, tin, zirconium, and germanium; phosphite compounds; phosphate compounds; and amine compounds.

The weight average molecular weight (Mw) of the crystalline polyester resin is preferably in the range of 6,000 or about 6,000 to 35,000 or about 35,000, more preferably 6,000 to 30,000. If the molecular weight (Mw) is less than 6,000, the toner may decrease the strength of the fixed image for bending resistance, and if the weight average molecular weight (Mw) is more than 35,000, it becomes difficult to be taken into the non-crystalline resin having a high molecular weight.

The above-described weight average molecular weight may be determined by gel permeation chromatography (GPC). The molecular weight determination by GPC is carried out using a GPC·HLC-8120; a determination apparatus manufactured by Tosoh Corporation, TSK gel Super HM-M (15 cm), a column manufactured by Tosoh Corporation, and THF as a solvent. The weight average molecular weight is calculated from the determination result using a molecular weight calibration curve which have been prepared with a monodispersed polystyrene standard sample.

The melting temperature (Tm) of the crystalline polyester resin used in an exemplary embodiment is preferably in the range 60° C. or about 60° C. to 120° C. or about 120° C., and more preferably in the range of 70° C. or about 70° C. to 100° C. or about 100° C. If the melting temperature of the crystalline polyester resin is less than 60° C., toner powder aggregation may easily occur, and storability of the fixed image may be impaired. On the other hand, if the melting temperature is higher than 120° C., low temperature fixing may be inhibited due to rough image occurrence.

The melting point of the above crystalline polyester resin is determined as a peak temperature of the endothermic peak obtained by the differential scanning calorimetry (DSC) as mentioned above.

The content of the crystalline polyester resin in the toner is preferably in the range of 1% by weight to 40% by weight more preferably in the range of 5% by weight to 30% by weight. If the content of the crystalline polyester resin is less than 1% by weight, a sufficient low temperature fixing might not be achieved in some cases. Further, if the content of the crystalline polyester resin is more than 40% by weight, toner crushing due to the softness of the crystalline resin is occurred, and filming of the photoreceptor as well as image defect due to contamination of the components in the image formation system using a charge roll and a transfer roll is easy to occur.

(Non-Crystalline Polyester Resin)

As the non-crystalline resin used in an exemplary embodiment, known polyester resins may be used. The non-crystalline polyester resin used is synthesized from a polyvalent carboxylic acid component and a polyhydric alcohol component. Referring to the above non-crystalline polyester resin, a commercial product may be used or a resin may be synthesized and then be used, and only one kind of the non-crystalline polyester resin may be used, or a mixture of two or more of the polyester resins may also be used.

Examples of the above-described polyhydric alcohol component in the non-crystalline polyester resin include divalent alcohol components such as ethylene glycol, propylene glycol, 1,4-butanediol, 2,3-butanediol, diethylene glycol, triethylene glycol, 1,5-pentanediol, 1,6-hexanediol, neopentylene glycol, 1,4-cyclohexanedimethanol, dipropylene glycol, polyethylene glycol, polypropylene glycol, bisphenol A, and hydrogenated bisphenol A, etc. In addition, as the trivalent or higher alcohol components, glycerine, sorbitol, 1,4-sorbitol, trimethylolpropane and the like may be used.

Examples of the divalent carboxylic acid component which may be condensed with the above polyhydric alcohol component include aromatic carboxylic acids such as terephthalic acid, isophthalic acid, phthalic anhydride, trimellitic anhydride, pyromellitic acid, naphthalenedicarboxylic acid; aliphatic saturated carboxylic acids such as succinic acid, alkenylsuccinic acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, 1,18-octadecanedicarboxylic acid, or the like; aliphatic unsaturated dicarboxylic acids such as maleic acid, maleic anhydride, fumaric acid, itaconic acid, itaconic anhydride, citraconic acid, citraconic anhydride, methaconic acid; alicyclic carboxylic acids such as cyclohexanedicarboxylic acid; and lower alkyl esters or acid anhydrides of these acids, and one or two or more of these polyvalent carboxylic acids may be used.

Among those polycarboxylic acids, aliphatic unsaturated dicarboxylic acids are preferable in view of improving an affinity to the crystalline polyester resin of which the structure is highly linear because aliphatic unsaturated dicarboxylic acids have a planar structure. Especially, fumaric acid is preferable, since carboxylic groups are located at the trans-position of the double bond, and the linearity of the resin structure as well as the affinity may be further enhanced.

In addition, when an alkenylsuccinic acid or its anhydride is used, the presence of an alkenyl group that is more hydrophobic compared to other functional groups may enable the crystalline polyester resin to be mutually dissolved more easily. Examples of the alkenylsuccinic acid include n-dodecylsuccinic acid, n-dodecenylsuccinic acid, isododecylsuccinic acid, isododecenylsuccinic acid, n-octylsuccinic acid, n-octenylsuccinic acid, and their acid anhydrides, acid chlorides and lower alkyl esters having 1 to 3 carbon atoms.

Furthermore, by containing a trivalent or higher valent carboxylic acid, a polymer chain may take a cross-linked structure, and such a cross-linked structure may exhibit an effect of fixing the crystalline resin which has been once mutually dissolved with the non-crystalline resin and of making the separation difficult.

Examples of the trivalent or higher valent carboxylic acids include trimellitic acid such as 1,2,4-benzenetricarboxylic acid and 1,2,5-benzenetricarboxylic acid, 1,2,4-naphthalenetricarboxylic acid, hemimellitic acid, trimesic acid, mellophanic acid, prehnitic acid, pyromellitic acid mellitic acid, 1,2,3,4-butanetetracarboxylic acid, and their acid anhydrides, acid chlorides and lower alkyl esters having 1 to 3 carbon atoms. Among these, trimellitic acid is especially suitable. These may be used solely, or two or more thereof may be used in combination.

The acid component may include a dicarboxylic acid component having a sulfonic acid group. In addition to the aliphatic dicarboxylic acids and aromatic dicarboxylic acids. The dicarboxylic acid having the sulfonic acid group may enable a coloring material such as pigments to be dispersed favorably. Further, in the production of a dispersion of binder resin particles by emulsifying or suspending the whole resin in water, if the dicarboxylic acid component has a sulfonic acid group, emulsification or suspension formation may be, as mentioned later, performed without surfactants.

From the above reason, it is desirable that the non-crystalline polyester resin contains a component obtained by reacting at least one of aliphatic unsaturated dicarboxylic acids and anhydrides thereof, at least one of alkenylsuccinic acids and anhydrides thereof and at least one of trimellitic acid and anhydrides thereof. Moreover, as mentioned above, the amount of the aliphatic unsaturated dicarboxylic acid in the total acid components is such that those in the low molecular weight non-crystalline polyester resin is higher that those in the high molecular weight non-crystalline polyester resin.

The polymerization method is according to the method as in the case of the crystalline polyester resin.

The molecular weight of the non-crystalline polyester resin is not particularly limited and, for example, in the case where a resin of a high molecular weight component and a resin of a low molecular weight component are each synthesized and the products are served as a binder resin, the weight average molecular weight Mw of the high molecular weight component is preferably in the range of 30000 or about 30000 to 200000 or about 200000, more preferably in the range of 30000 or about 30000 to 100000 or about 100000, and still more preferably 35000 to 80000.

By controlling the molecular weight of the high molecular weight component within this range, shell effect may be effectively expressed in the aggregation process. If the molecular weight Mw is more than 200000, melting/coalescing may require higher temperature and/or longer time, and therefore, the crystalline polyester resin or the composite particles may be exposed from the inside, and thus the shell effect might not be obtained. Reversely, if Mw is less than 30000, the affinity may be enhanced due to the low molecular weight and the shell effect might not be obtained.

The Mw of the low molecular weight component resin is preferably in the range of 8000 or about 8000 to 25000 or about 25000, more preferably in the range of 8000 or about 8000 to 22000 or about 22000, and further preferably in the range of 9000 or about 9000 to 2000 or about 20000.

By controlling the molecular weight of the low molecular weight component within this range, composite particle formation with the crystalline polyester resin at the initial stage of the aggregation process may proceed easily, so that uniform toner particles may be easily formed. If the Mw becomes more than 25000, composite particle formation with the crystalline polyester resin may not proceed smoothly, and aggregates solely of the crystalline resin might be easy to be formed. Reversely, if the Mw is less than 8000, the strength of the resin may be decreased so that sufficient image strength and toner strength might not be obtained.

In the production of a binder resin by mixing a resin of the high molecular weight component with a resin of the low molecular weight component, the mixing ratio P/Q (P: weight of high molecular weight component, Q: weight of low molecular weight component) of both components is preferably in the range of 10/90 to 70/30, more preferably 20/80 to 70/30, and still more preferably 25/75 to 70/30. By controlling the mixing ratio within this range, the high molecular weight component and the low molecular weight component, both of which were used for mixing, are almost contained respectively in the eluate F(0-10) on the high molecular weight side and the eluate F(80-100) on the low molecular weight side, and thus controlling may become easy.

(Colorant)

The colorant used in the toner of an exemplary embodiment may be a dye or a pigment, and preferably a pigment from the viewpoint of light resistance and water resistance.

Examples colorants which may be used include known pigments such as carbon black, aniline black aniline blue, chalcoil blue, chrome yellow, ultramarine blue, Du Pont oil red, quinoline yellow, methylene blue chloride, phthalocyanine blue, malachite green oxalate, lamp black, rose bengal, quinacridone, benzidine yellow, C.I. pigment red 48:1, C.I. pigment red 57:1, C.I. pigment red 122, C.I. pigment red 185, C.I. pigment red 238, C.I. pigment yellow 12, C.I. pigment yellow 17, C.I. pigment yellow 180, C.I. pigment yellow 97, C.I. pigment yellow 74, C.I. pigment blue 15:1, and C.I. pigment blue 15:3.

The content of the above-described colorant in the toner for electrostatic charge image development of an exemplary embodiment is preferably in the range of 1 to 30 parts by weight relative to 100 parts by weight of the binder resin. Further, as needed, a surface-treated colorant may be used or a pigment dispersant may be used. By selecting the kind of the colorants, a yellow toner, magenta toner, cyan toner, black toner or the like is obtained.

(Other Additives)

The toner of an exemplary embodiment may contain a releasing agent as needed. Examples of the releasing agent include paraffin wax such as low molecular weight polypropylene or low molecular weight polyethylene; silicone resin; rosins; rice wax; and carnauba wax. The melting temperature of these releasing agents is preferably 50° C. to 100° C. and more preferably 60° C. to 95° C. The content of the toner in the releasing agent is preferably 0.5 to 15% by weight, and more preferably 1.0 to 12% by weight. If the content of the releasing agent is less than 0.5% by weight, a peeling defect may occur particularly in oilless fixing. If the content of the releasing agent is more than 15% by weight, the reliability of the image quality and image formation may be decreased due to the deterioration of the toner flowerability and others.

To the toner of an exemplary embodiment, in addition to the above-described components, various components such as an internal additive, charge controlling agent, inorganic powder (inorganic particle), or organic particles may be added as needed.

Examples of the internal additive include metals such as ferrite, magnetite, reduced iron, cobalt, nickel, or manganese, alloys, or magnetic substances such as a compound containing these metals.

The inorganic particles may be added for various purposes, and, for example, may be added for adjusting the viscoelastic property in the toner. By adjusting of the viscoelastic property, the glossiness of the image and the penetration of the toner into paper may be adjusted. As the inorganic particles, known inorganic particles such as silica particles, titanium oxide particles, alumina particles, cerium oxide particles, or these particles which have been subjected to surface hydrophobization may be used alone or in combination of two or more thereof. From the viewpoints of not impairing the color forming property and transparency such as OHP permeability, silica particles which have a smaller refractive index than a binder resin may be used as the inorganic particles. Further, silica particles may have been subjected to various surface treatments, and for example, those have been subjected to surface treatment with a silane-based coupling agent, titanium-based coupling agent, or silicone oil may be used.

(Properties of Toner)

In the exemplary embodiment the volume average particle size of the toner is preferably in the range of 4 to 9 μm, more preferably in the range of 4.5 to 8.5 μm, and further preferably in the range of 5 to 8 μm. If the volume average particle size is smaller than 4 μm, the toner flowability tends to decrease, the charging property of each of the particles tends to decrease, and fogging of the background, the spill of the toner from the developing device or the like tends to occur due to widening of the charging distribution. Moreover, if the volume average particle size is smaller than 4 μm, the cleanability may be significantly problematic. If the volume average particle size is larger than 9 μm, the resolution deteriorates and thus a sufficient image quality may not be achieved, resulting in that it may become difficult to satisfy the recent demand for a high quality image.

The volume average particle size may be measured at an aperture diameter of 50 μm using a COULTER MULTISIZER II (manufactured by Beckman-Coulter). For the measurement, the toner is dispersed in an aqueous electrolyte solution (aqueous ISOTON solution), followed by dispersion of ultrasonic waves for 30 seconds or more, and thereafter the measurement is carried out.

Further, the toner of an exemplary embodiment may have a spherical shape having a shape factor SF1 in the range of 110 or about 110 to 140 or about 140. When the toner has a spherical shape in this age, the transfer efficiency and image denseness are improved, and an image of high quality may be formed.

The shape factor SF1 is more preferably in the range of 115 to 138.

The shape factor SF1 is determined by the following formula (1).

$$SF1=(ML^2/A)\times(\pi/4)\times 100 \qquad \text{Formula (1)}$$

In the above formula (1), ML, represents an absolute maximum length of the toner particles, and A represents a projected area of the toner particles.

The SF1 is quantified mainly by analyzing a microscope image or scanning electron microscope (SEM) image with an image analyzer. The SF1 is calculated, for example, as follows. That is, an optical microscope image of higher alcohol particles distributed on the surface of a slide glass is taken in a Luzex image analyzer via a video camera, the maximum length and the projected area of 100 particles are measured, calculation is carried out by the above formula (1), and the average is calculated to obtain the SF1.

The method for manufacturing a toner for electrostatic charge image development according to an exemplary embodiment may be, for example, a dry process or a wet process. In this case, the method for allowing the high molecular weight component/low molecular weight component of the non-crystalline polyester resin to have the varied amount of acid-derived components is not particularly limited. Examples of such methods include a method wherein the resin obtained by polymerizing the high molecular weight component and the resin obtained by polymerizing, the low molecular weight component are fused and mixed; a method wherein polymerization is performed to a certain degree of the molecular weight, a monomer component having a different composition is additionally added to advance further polymerization so that the resin skeletons with different compositions are extended; and a method wherein the high molecular weight component/low molecular weight component are each independently polymerized to prepare dispersions respectively and such dispersions are mixed together in the aggregation process.

However, a kneading and grinding method, which is one of dry processes, is not preferable because the structure of the low molecular weight component of the non-crystalline resin and that of the high molecular weight component of the non-crystalline resin may not be controlled separately. On the other hand, examples of the wet process include an emulsifying aggregation method, a melting suspension method, and a solution suspension method. As mentioned above, the toner property of an exemplary embodiment is based on the composition control that addresses the problems occurred in the emulsion aggregation method, and thus a toner having a structure with a sufficient uniformity may be obtained by the emulsion aggregation method.

<Manufacturing Method of Toner for Electrostatic Charge Image Development>

The method for manufacturing the toner for electrostatic charge image development of an exemplary embodiment includes dispersing a crystalline polyester resin in an aqueous medium to emulsify crystalline polyester resin particles and dispersing a non-crystalline polyester resin in an aqueous medium to emulsify non-crystalline polyester resin particles (each may also be referred to as "crystalline resin particles" and "non-crystalline resin particles"), respectively; aggregating the crystalline polyester resin particles and the non-crystalline polyester resin particles to form aggregated particles; and coalescing the aggregated particles, thereby manufacturing the toner for electrostatic charge image development as mentioned above.

By passing through each above process, the toner particles in which the high molecular weight non-crystalline resin which does not contains the crystalline resin so much includes the composite particles in which the crystalline resin and the low-molecular weight non-crystalline resin are sufficiently uniformized, may be efficiently produced.

As an example of the method for manufacturing the toner for electrostatic charge image development of an exemplary embodiment, a manufacturing method by an emulsion aggregation method is described below.

The emulsion aggregation method includes an emulsion process for emulsifying the raw materials of the toner to form resin particles (emulsified particles), an aggregation process for aggregating the resin particles to form aggregates, and a coalescence process for coalescing the aggregates. When the emulsion aggregation method is used, the composition and structure from the inside to the surface of the toner particles may be easily controlled using plural kinds of particles.

(Emulsification Process)

The crystalline resin particles may be formed, for example, by applying a shearing force using a disperser to a mixed liquid of an aqueous medium and a crystalline resin. In that time, particles may be formed with the reduced viscosity of the resin component by heating. Further, a dispersant may be used for stabilizing the dispersed resin particles. Alternatively, if the resin is soluble in an oil based solvent having relatively low solubility in water, the resin may be dissolved in the solvent, and the mixture is dispersed in water in a particle form together with a dispersant or a polymer electrolyte, followed by heating or decompressed to evaporate the solvent, and thereby preparing a dispersion of the crystalline resin particles.

Also, for the cases with a non-crystalline resin, a dispersion liquid of the non-crystalline resin particles may be prepared according to the above-described procedure. Regarding the dispersion liquid of the non-crystalline resin particles in an exemplary embodiment, the dispersion of the high molecular weight non-crystalline resin and the dispersion of the low molecular weight non-crystalline resin may be separately prepared.

Examples of the aqueous medium include water such as distilled water or ion-exchanged water; alcohols; and preferably water alone.

Examples of the dispersant used in the emulsification process include water-soluble polymers such as polyvinyl alcohol, methyl cellulose, ethyl cellulose, hydroxyethyl cellulose, carboxymethyl cellulose, sodium polyacrylate, or sodium polymethacrylate; surfactants such as anionic surfactants such as sodium dodecylbenzenesulfonate, sodium octadecylsulfate, sodium oleate, sodium laurate, or potassium stearate, cationic surfactants such as laurylamine acetate, stearylamine acetate, or lauryltrimethyl ammonium chloride, amphoteric ionic surfactants such as lauryldimethylamine oxide, nonionic surfactants such as polyoxyethylene alkyl ether, polyoxyethylene alkylphenyl ether, or polyoxyethylene alkylamine; and inorganic salts such as tricalcium phosphate, aluminum hydroxide, calcium sulfate, calcium carbonate, or barium carbonate.

The content of the resin particles contained in the emulsion in the above emulsification process is preferably in the range of 10 to 50% by weight, and more preferably in the range of 20 to 40% by weight. If the content is less than 10% by weight, the particle diameter distribution broadens, which may deteriorate the toner properties. On the other hand, if the content becomes to be more than 50% by weight, uniform stirring may be difficult, which may make it difficult to obtain a toner with a narrow particle size distribution and uniform properties.

In the dispersing method to obtain the emulsion, a disperser, such as a homogenizer, homomixer, pressurization kneader, extruder; or media disperser may be used.

With regard to the size of the resin particles, the average particle size (volume average particle size) thereof is preferably in the range of 0.01 to 1.0 μm, more preferably in the range of 0.03 to 0.6 μm, and further preferably in the range of 0.03 to 0.4 μm.

As the dispersing method of the colorant, any method, such as an ordinary dispersing method using a rotation shearing homogenizer or a mill including media, e.g., a ball mill, a sand mill and a Dyno mill, may be used without any limitation.

If necessary, an aqueous dispersion of these colorants may be prepared by using a surfactant, or an organic dispersion of these colorants may also be prepared by using a dispersant. Hereinafter, these dispersions of the colorants will be referred to as "colorant dispersion" in some cases. As the surfactant or dispersant used for such dispersion, those according to dispersants usable for dispersing the crystalline polyester resins and the like may be used.

The addition amount of the colorants is preferably in the range of 1% or about 1% to 20% or about 20% by weight, more preferably 1% or about 1% to 10% or about 10% by weight, furthermore preferably 2% or about 2% to 10% or about 10% by weight, and especially preferably 2% to 7% by weight.

When the colorant is admixed in the emulsification process, blending of the polymer with the colorant may also be carried out by blending the solution of the polymer in an organic solvent with the colorant or the dispersion of the colorant in an organic solvent.

(Aggregation Process)

In the aggregation process, the dispersion of the crystalline resin particles, the dispersion of the non-crystalline resin particles, the dispersion of the colorant and others are mixed to make a mixed liquid, and the liquid is heated at a temperature equal to or lower than the glass transition temperature of the non-crystalline resin to cause aggregation, thereby to form aggregated particles. The formation of the aggregated particles is carried out by adjusting the pH of the mixed liquid to be acidic while the liquid is stirred. The pH is preferably in the range of 2 to 7, more preferably in the range of 2.2 to 6, and further preferably in the range of 2.4 to 5. On this occasion, it is also effective to use a coagulant.

As the coagulant to be used, a surfactant having a polarity opposite to the polarity of the above surfactant used as the dispersant, as well as an inorganic metal salt and a divalent or higher valent metal complex may be preferably used. In particular, a metal complex is particularly preferable because the usage of surfactant may be reduced and the charging property may be improved.

Examples of the inorganic metal salt include metal salts such as calcium chloride, calcium nitrate, barium chloride, magnesium chloride, zinc chloride, aluminum chloride, or aluminum sulfate, and inorganic metal salt polymers such as polyaluminum chloride, polyaluminum hydroxide, or calcium polysulfide. Among them, aluminum salts and polymers thereof are preferable. For obtaining a sharper particle size distribution, with regard to the valence of the inorganic metal salt, divalent is better than monovalent, trivalent is better than divalent and tetravalent is better than trivalent.

When the toner particles are produced in an exemplary embodiment, it is desirable that a resin particle dispersion alone is first added to the aggregation system, aggregation of the resin particles solely is conducted, and then a dispersion of colorants and releasing agents is added thereto. As a result, inhibition of the resin particle aggregation caused by the existence of releasing agent particles etc. may be avoided, and desirable toner particle structure as mentioned above may be formed efficiently.

Further, a toner having a structure in which the surface of core aggregated particles is coated with non-crystalline resin particles may be prepared by additionally adding non-crystalline resin particles at the point when the aggregated particles becomes to have a desired particle size. In this case, since the crystalline resin is hard to be exposed at the toner surface, the non-crystalline resin particles to be additionally added is desirably the high molecular weight non-crystalline resin particles. Before the additional addition, the addition of a coagulant or the adjustment of the pH may be carried out.

(Coalescence Process)

In the coalescence process, the pH of the suspension of the aggregated particles is increased to the range of 3 to 9 under the stirring conditions according to the above aggregation process, thereby the progress of the aggregation is stopped, and the aggregated particles are coalesced by heating them at a temperature equal to or higher than Tg of the high molecular weight non-crystalline resin or equal to or higher than Tm of the crystalline resin. The time for the above heating may be the time enough for coalescing, and may be about 0.5 to 10 hours.

Cooling is performed after coalescence, and coalesced particles are obtained. Further, crystallization may be promoted by slowing down the cooling rate, so-called slow cooling, in the cooling process in the range of a melting temperature±15° C. of the crystalline resin.

The coalesced particles obtained by coalescing are subjected to a solid-liquid separation process such as filtration, and if necessary, a washing process, and a drying process, to form toner particles.

In an exemplary embodiment, the surface of the toner particles may be treated with external additives such as a fluidizing agent or auxiliary agent. As an external additive, known particles may be used, for example, inorganic particles such as surface hydrophobitized silica particles, titanium oxide particles, alumina particles, cerium oxide particles, or carbon black and polymer particles such as polycarbonate, polymethyl methacrylate, or silicone resin. Two or more of the above external additives may be used, and at least one of the external additives may have an average primary particle size in the range of 30 nm or about 30 nm to 200 nm or about 200 nm, more preferably in the range of 30 nm to 180 nm.

If the average primary particle size of the external additive is smaller than 30 nm, although the initial flowability of the toner is favorable, the non-electrostatic adhesion force between the toner and a photoreceptor may not be reduced, which may decrease the transfer efficiency and therefore may easily cause filming, or increase the variations in the density of an image. Further, the particles may be buried in the toner surface by the stress over time in the developing device, which may vary the charging property, and in turn may cause problems such as the decrease in the copy density or fogging in the background area. If the average primary particle size is larger than 200 nm, the particles may be readily detached from the toner surface, and may deteriorate the flowability to cause the occurrence of filming.

<Electrostatic Charge Image Developer>

The toner for electrostatic charge image development of an exemplary embodiment is used as it is as a one-component developer, or as a two-component developer. When used as a two-component developer, the toner is used in combination with a carrier.

The carrier which may be used for the two-component developer is not particularly limited, and known carriers may be used. Examples thereof include magnetic metals such as iron oxide, nickel, or cobalt, magnetic oxides such as ferrite or magnetite, resin-coated carriers composed of these substances as a core material having a resin coating layer on the surface thereof and magnetic dispersed carriers. Further, the carrier may be of resin dispersion type in which a conductive material or the like is dispersed in a matrix resin.

Examples of the coating resin and the matrix resin used for the carrier include, but not limited to, polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymer, styrene-acrylic acid copolymer, straight silicone resin containing an organosiloxane bond or modified products thereof, fluorocarbon resin, polyester, polycarbonate, phenol resin, and epoxy resin.

Examples of the conductive material include, but not limited to, metals such as gold, silver, or copper, carbon black, as well as titanium oxide, zinc oxide, barium sulfate, aluminum borate, potassium titanate, tin oxide, and carbon black.

Examples of the core material of the carrier include magnetic metals such as iron, nickel, or cobalt, magnetic oxides such as ferrite or magnetite, and glass beads. For using a carrier in a magnetic brush method, the core material thereof is preferably a magnetic material. The volume average particle size of the core material for the carrier is commonly in the range of 10 to 500 μm and preferably in the range of 30 to 100 μm.

Further, examples of the method for resin-coating the surface of the core material of the carrier include a method of coating the core material with a solution for forming a coating layer in which the above coating resin and, as needed, various additives have been dissolved in an appropriate solvent. The solvent is not particularly limited, and may be selected according to the type, application property and the like of the coating resin to be used.

Specific examples of the resin coating method include a dipping method in which the core material of the carrier is dipped in a solution for forming a coating layer, a spray method in which a solution for forming a coating layer is sprayed on the surface of the core material of the carrier, a fluid bed method in which a solution for forming a coating layer is sprayed with the core material of the carrier suspended by flowing air, and a kneader coater method in which the core material of the carrier is mixed with a solution for forming a coating layer in a kneader coater, subsequently the solvent is removed.

In the above-described two-component developer, the mixing ratio (by weight) between the toner of an exemplary embodiment and the carrier is preferably roughly in the range of toner:carrier=1:100 to 30:100, and more preferably roughly in the range of 3:100 to 20:100.

<Image Forming Apparatus>

In the next place, the image forming apparatus of an exemplary embodiment using the toner for electrostatic charge image development of an exemplary embodiment is described.

The image forming apparatus of an exemplary embodiment includes an image holding member, a developing part that develops an electrostatic charge image formed on the image holding member into a toner image by a developer, a transfer part that transfers the toner image formed on the image holding member to a transfer body, and a fixing part that fixes the toner image transferred to the transfer body. As the developer, the electrostatic charge image developer of an exemplary embodiment is used.

In the image forming apparatus, for example, the portion including the developing part may have a cartridge structure (process cartridge) which is detachable from the main body of the image forming apparatus. As the process cartridge, the process cartridge of an exemplary embodiment which at least includes a developer holding body and contains the electrostatic charge image developer of an exemplary embodiment may be used.

An example of the image forming apparatus of an exemplary embodiment is illustrated below, but not limited thereto. Explanations are given only for main parts represented in the figures, and those for other parts are omitted.

In FIG. 1 and FIG. 2, 1Y, 1M, 1C, 1K, and 107 are each a photoreceptor (image holding member). 2Y, 2M, 2C, 2K, and 108 are each a charging roller 3Y, 3M, 3C and 3K are each a laser beam. 3 is an exposure device. 4Y, 4M, 4C, 4K and 111 are each a development device (developing part). 5Y, 5M, 5C, and 5K are each a primary transfer roller. 6Y, 6M, 6C, 6K, and 113 are each a photoreceptor cleaning apparatus (cleaning part). 8Y, 8M, 8C, and 8K are each a toner cartridge. 10Y, 10M, 10C and 10K are each a unit. 20 is an intermediate transfer belt. 22 is a drive roller. 24 is a supporting roller. 26 is a secondary transfer roller (transfer part). 28 and 115 are each a fixing device (fixing part). 30 is an intermediate transfer body cleaning device. 112 is a transfer device. 116 is a mounting rail. 117 is an opening for discharging exposure. 118 is an opening for exposure. 200 is a process cartridge. P and 300 are each a recording paper (transfer body).

FIG. 1 is a schematic block diagram showing a full color image forming apparatus of a train-of-four tandem type. The image forming apparatus shown in FIG. 1 includes first to fourth image forming units 10Y, 10M, 10C, and 10K of electrophotographic type for outputting images of yellow (Y), magenta (M), cyan (C), and black (K), respectively, on the basis of the color-dispersed image data (image forming part). These image forming units (hereinafter simply referred to as "units") 10Y, 10M, 10C, and 10K are arranged in parallel in the horizontal direction at a predetermined distance apart from each other. These units 10Y, 10M, 10C, and 10K may be process cartridges which are detachable from the main body of the image forming apparatus.

An intermediate transfer belt 20 as an intermediate transfer body is extended in the superior region of the drawing of the units 10Y, 10M, 10C, and 10K through the units. The intermediate transfer belt 20 is wound around a driving roller 22 and a supporting roller 24 in contact with the inner surface of the intermediate transfer belt 20, the rollers being arranged apart from each other in the horizontal direction in the figure, in such a manner that the belt travels in the direction from the first unit 10Y to the fourth unit 10K. The supporting roller 24 is biased by a spring or the like (not shown) in a direction away from the driving roller 22, and a predetermined tension is applied to the intermediate transfer belt 20 wound around these rollers. An intermediate transfer body cleaning device 30 is provided on the side of the image holding member of the intermediate transfer belt 20 opposite to the driving roller 22.

Further, four color toners of yellow, magenta, cyan, and black toners contained in the toner cartridges 8Y, 8M, 8C, and 8K may be supplied to the development device (developing unit) 4Y, 4M, 4C, and 4K of the units 10Y, 10M, 10C, and 10K, respectively.

Since the above first to fourth units 10Y, 10M, 10C, and 10K have an equivalent structure, the first unit 10Y for forming a yellow image arranged on the upstream side in the traveling direction of the intermediate transfer belt is described as a typical example. Descriptions of the second to fourth units 10M, 10C, and 10K are omitted by assigning the same reference numerals as the first unit 10Y to the corresponding parts, wherein the numerals are followed by magenta (M), cyan (C), or black (K) in place of yellow (Y).

The first unit 10Y has a photoreceptor 1Y which works as an image holding member. Around the photoreceptor 1Y, a charging roller 2Y that charges the surface of the photoreceptor 1Y to a predetermined potential, an exposure device 3 that exposes the charged surface to a laser beam 3Y based on the color-separated image signals to form an electrostatic charge image, a development device (developing part) 4Y that supply a charged toner to the electrostatic charge image to develop the electrostatic charge image, a primary transfer roller (primary transfer part) 5Y that transfers the developed toner image onto the intermediate transfer belt 20, and a photoreceptor cleaning device (cleaning part) 6Y that removes the toner remaining on the surface of the photoreceptor 1Y after primary transfer are arranged in this order.

The primary transfer roller 5Y is arranged within the intermediate transfer belt 20 in a position opposed to the photoreceptor 1Y. Further bias power supplies (not shown) for applying primary transfer bias are connected to each of the primary transfer rollers 5Y, 5M, 5C, and 5K. The bias power supplies are controlled by a control part (not shown) to vary the transfer bias to be applied to the primary transfer rollers.

The operation of forming a yellow image in the first unit 10Y is described below. In the first place, prior to the operation, the surface of the photoreceptor 1Y is charged to a potential of about −600V to −800V by the charging roller 2Y.

The photoreceptor 1Y includes a conductive substrate (volume resistivity at 20° C.: $1\times10^{-6}$ Ωcm or less) and a photosensitive layer disposed on the conductive substrate. The photosensitive layer normally has high resistance (resistance equivalent to that of common resins), and has the property of changing the specific resistance of the area irradiated with the laser beam 3Y. On this account, the laser beam 3Y is emitted to the surface of the charged photoreceptor 1Y via an exposure device 3 according to the image data for yellow transmitted from the control part (not shown). The laser beam 3Y is radiated to the photosensitive layer on the surface of the photoreceptor 1Y, thereby to form an electrostatic charge image of yellow printing pattern on the surface of the photoreceptor 1Y.

An electrostatic charge image is an image formed by charging on the surface of the photoreceptor 1Y, and is a so-called negative latent image formed as follows: irradiation with the laser beam 3Y decreases the specific resistance of the photosensitive layer in the irradiated area, thereby allowing the charges on the surface of the photoreceptor 1Y to pass trough, while charges remain in the area which has not irradiated with the laser beam 3Y to form an image.

The electrostatic charge image formed on the photoreceptor 1Y as described above is rotated to the predetermined development position along with the traveling of the photoreceptor 1Y. Then, at the development position, the electrostatic charge image on the photoreceptor 1Y is developed into a visible image (developed image) by the development device 4Y.

The development device 4Y contains, for example, a yellow toner having a volume average particle size of 7 μm which at least contains a yellow colorant, a crystalline resin, and a non-crystalline resin. The yellow toner is friction-charged by being stirred in the development device 4Y to have an electric charge having the same polarity (negative polarity) with the electrified charge on the photoreceptor 1Y, and is held on the developer roll (developer holding body). Then the surface of the photoreceptor 1Y passes through the development device 4Y, thereby to adhere the yellow toner electrostatically to the discharged latent image area on the surface of the photoreceptor 1Y, and the latent image is developed by the yellow toner. The photoreceptor 1Y formed with the yellow toner image keeps traveling at a predetermined rate, and the toner image developed on the photoreceptor 1Y is carried to a predetermined primary transfer position.

When the yellow toner image on the photoreceptor 1Y is carried to the primary transfer position, a predetermined primary transfer bias is applied to a primary transfer roller 5Y, and an electrostatic force from the photoreceptor 1Y toward the primary, transfer roller 5Y is exerted on the toner image, thereby to transfer the toner image on the photoreceptor 1Y onto the intermediate transfer belt 20. The applied transfer bias has a positive polarity opposite to the negative polarity of the toner, and for example, in the first unit 10Y, the bias is controlled by the control part (not shown) to about +10 μA.

On the other hand, the toner remaining on the photoreceptor 1Y is removed and collected by a cleaning device 6Y.

Further, the primary transfer bias applied to primary transfer rollers 5M, 5C, and 5K in the second unit 10M and afterward is also controlled according to the first unit.

Then, the intermediate transfer belt 20 onto which the yellow toner image has been transferred by the first unit 10Y is sequentially carried through the second to fourth units 10M, 10C, and 10K, and the toner images of each color are overlaid and transferred as multi-layers.

The intermediate transfer belt 20 onto which a four color toner image is transferred as the multi-layers through the first to fourth units comes to a secondary transfer part which is constituted by the intermediate transfer belt 20, the supporting roller 24 in contact with the inner surface of the intermediate transfer belt 20, and a secondary transfer roller (secondary transfer past) 26 arranged on the intermediate transfer belt 20 on the image holding side. On the other hand, a recording paper (transfer body) P is fed at a predetermined time via a feeding mechanism to the gap where the secondary transfer roller 26 and the intermediate transfer belt 20 are pressed against each other under pressure, and a predetermined secondary transfer bias is applied to the supporting roller 24. At this time, the applied transfer bias has the same polarity (−) with the polarity of the toner (−), thereby an electrostatic force from the intermediate transfer belt 20 toward the recording paper P is exerted on the toner image, and the toner image on the intermediate transfer belt 20 is transferred onto the recording paper P. The secondary transfer bias is detected according to the resistance detected by a resistance detection part, (not shown) for detecting the resistance in the secondary transfer part, and is subjected to voltage control.

Subsequently the recording paper P is sent to a fixing device (fixing part) 28, the toner image is heated, and the toner image in which colors are layered is melted and fixed on the recording paper P. The recording paper P on which the fixing of the color image has been completed is carried toward an ejection part, thus a series of steps for forming a color image is finished.

The image forming apparatus exemplified above has a structure in which a toner image is transferred to the recording paper P via the intermediate transfer belt 20, but is not limited to the structure, and may have a structure in which a toner image is transferred to a recording paper directly from the photoreceptor.

<Process Cartridge, Toner Cartridge>

Figure 2:
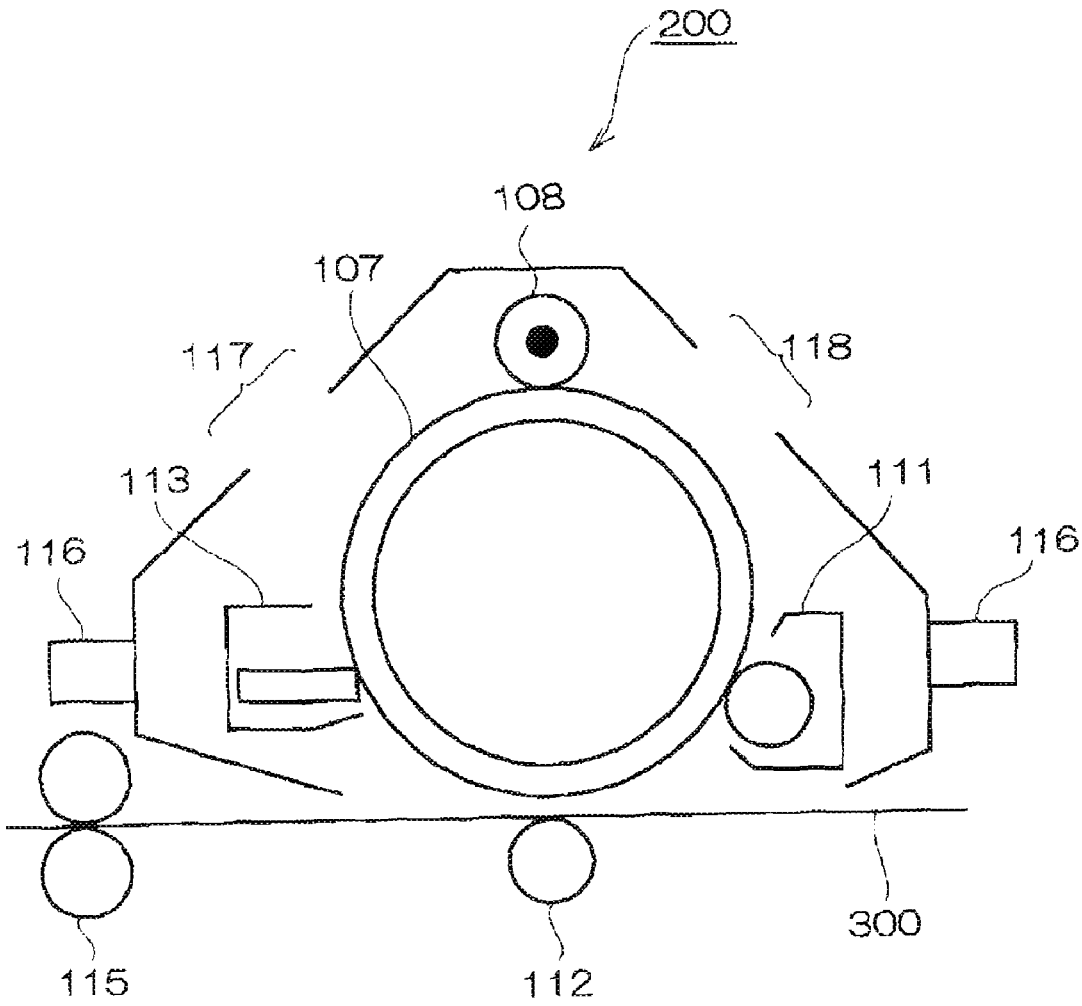
FIG. 2 is a schematic block diagram showing an example of a process cartridge of an exemplary embodiment of the invention.

FIG. 2 is a schematic block diagram shorting an example of the process cartridge which contains the electrostatic charge image developer of an exemplary embodiment. A process cartridge 200 includes a photoreceptor 107, a charging roller 108, a development device 111, a photoreceptor cleaning device (cleaning part) 113, an opening 118 for exposure, and an opening 117 for discharging exposure and these are integrated as a unit using a mounting rail 116.

The process cartridge 200 is detachable from the main body of the image forming apparatus including a transfer device 112, a fixing device 115, and other components (not shown), and serves as a part of the image forming apparatus together with the main body of image forming apparatus. The numeral 300 represents a recording paper.

The process cartridge shown in FIG. 2 includes a charging device 108, a development device 111, a cleaning device (cleaning part) 113, and an opening 118 for exposure, and an opening 117 for discharging exposure. These devices may be selectively combined. The process cartridge of an exemplary embodiment of the invention includes, in addition to the photoreceptor 107, at least one selected from the group consisting of the charging device 108, the development device 111, the cleaning device (cleaning part) 113, opening 118 for exposure, and opening 117 for discharging exposure.

In the next place, the toner cartridge of an exemplary embodiment is further described. The toner cartridge of an exemplary embodiment is detachably placed in the image forming apparatus, wherein at least in the toner cartridge which contains the toner to be fed to the developing part provided in the above image forming apparatus, the toner is the toner of an exemplary embodiment of the invention as already mentioned. The toner cartridge of an exemplary embodiment of the invention may be any toner cartridge as long as it contains at least a toner, and may contain, for example, a developer, depending on the mechanism of the image forming apparatus.

Accordingly, in an image forming apparatus having a structure in which a toner cartridge is detachable, the use of a toner cartridge containing the toner of an exemplary embodiment of the invention may allow to maintain storability even in the toner cartridge which is especially miniaturize, and may enable to attain low temperature fixing while a high quality image is being maintained.

The image forming apparatus shown in FIG. 1 is an image forming apparatus having a structure in which the toner cartridges 8Y, 8M, 8C, and 8K are detachable, and the development devices 4Y, 4M, 4C, and 4K are connected to the toner cartridges corresponding to each development device (color) through toner feeding pipes (not shown). Further, when the toner contained in the toner cartridge draws to an end, the toner cartridge may be replaced.

EXAMPLES

The present invention will be illustrated in detail by the following Examples and Comparative Examples. However, the invention is not limited to the following Examples. Unless otherwise noted, "part" refers to "part by weight", and "%" refers to "% by weight".

<Determination Methods for Various Properties>

In the first place, the methods for determining the physical properties of the toner and others used in Examples and Comparative Examples (except for the above-mentioned method) are described.

(Determination Method of Molecular Weight and Molecular Freight Distribution of Resin)

In the Examples, the molecular weight and molecular weight distribution of the crystalline polyester resin and others are determined under the following conditions. GPC is carried out with an "HLC-8120GPC, SC-8020 (manufactured by Tosoh Corporation) apparatus", two columns, "TSK gel, Super HM-H (6.0 mm inner diameter×15 cm, manufactured by Tosoh Corporation)", and THF (tetrahydrofuran) as an eluent. The experiment is carried out using an IR detector under the following experimental conditions: sample concentration of 0.5%, flow rate of 0.6 ml/min, sample injection amount of 10 μl, and determination temperature 40° C. Further, the calibration curve is prepared from 10 samples, "Polystyrene Standard Sample TSK Standard": "A-500", "F-1", "F-10", "F-80", "F-380", "A-2500", "F-4", "F-40", "F-128", and "F-700" (manufactured by Tosoh Corporation).

The interval for collecting the data in the sample analysis is 300 ms.

(Volume Average Particle Diameter of Resin Particles, Colorant Particles, and Others)

The volume average particle size of the resin particles, colorant particles, and others is determined with a laser diffraction particle size distribution meter (LA-700, manufactured by Horiba, Ltd.).

(Determination Method of Melting Temperature and Glass Transition Temperature of Resins)

The melting temperature (Tm) of the crystalline resin and the glass transition temperature (Tg) of the non-crystalline resin are, according to ASTM D3418-8, determined using a differential scanning calorimeter (manufactured by Shimadzu Corporation, DSC60, provided with an automatic tangential processing system) at heating rate of 10° C./minute from 25° C. to 150° C. The melting point is a peak temperature of the endothermic peak, and the glass transition point is a temperature at an intersecting point of the base line and the start of the endothermic peak.

<Preparation of Each Dispersion>

(Dispersion of Non-Crystalline Polyester Resin)

Each material with the material composition ratio as shown in Table 1 is added to a reactor equipped with a stirrer, a thermometer, a condenser, and a nitrogen gas introduction tube, and the atmosphere in the reactor is substituted by a dry nitrogen gas. Then, the catalyst shown in Table 1 is added, and the reaction is carried out at 195° C. for 6 hours with stirring in a nitrogen gas stream. The temperature is further raised to 240° C. and the reaction is conducted with stirring for 6 hours. After reduction of the inside pressure of the reactor to 100 mm/Hg, the reaction is conducted with stirring for 0.5 hour to obtain pale yellow transparent non-crystalline polyester resins (1) to (10).

TABLE 1

| | | Resin (1) | Resin (2) | Resin (3) | Resin (4) | Resin (5) | Resin (6) | Resin (7) | Resin (8) | Resin (9) | Resin (10) |
|---|---|---|---|---|---|---|---|---|---|---|---|
| Acid component (mol %) | Dimethyl terephthalate | 60 | 55 | 65 | 65 | 60 | 50 | 30 | 50 | 80 | 25 |
| | Dimethyl fumarate | 5 | 10 | — | 15 | 20 | 40 | 60 | — | 15 | 65 |
| | Dimethyl maleate | — | — | — | — | — | — | — | 40 | — | — |
| | Dodecenylsuccinic anhydride | 30 | 35 | 25 | 15 | 20 | 10 | 10 | 10 | 5 | 5 |
| | Trimellitic anhydride | 5 | — | 10 | 5 | — | — | — | — | — | — |
| Alcohol component (mol %) | BPA-EO | 55 | 20 | 50 | 70 | 10 | 5 | 5 | 5 | 20 | 5 |
| | BPA-PO | 45 | 80 | 50 | 30 | 90 | 95 | 95 | 95 | 80 | 95 |
| Catalyst (mol %) | Dibutyltin oxide | 0.05 | 0.05 | 0.05 | 0.05 | 0.05 | 0.05 | 0.05 | 0.05 | 0.05 | 0.05 |

BPA-EO: Bisphenol A-ethylene oxide 1 mol adduct
BPA-PO: Bisphenol A-propylene oxide 1 mol adduct Subsequently, the resulting non-crystalline polyester resins (1) to (10) are dispersed with a reconstructed high temperature/high pressure dispenser of CABITRON CD1010 (manufactured by Eurotech S.p.A.). The pH in the composition of ion-exchange water 80% and polyester resin 20% is adjusted to 8.5 with ammonia, and the CABITRON is operated under the conditions of a rotator rotating speed of 60 Hz and a pressure of 5 kg/cm$^2$ under heating at 140° C. with a heat exchanger to obtain non-crystalline polyester resin dispersions (1) to (10) (solid content: 20%).

The molecular weights and glass transition temperatures (Tg) of the obtained non-crystalline polyester resins (1) to (10), and volume average particle sizes in the resin dispersions using the same are shown in Table 2

(Dispersion of Crystalline Polyester Resin)

Each material is mixed in a flask in the material composition ratio as shown in Table 3, and dehydration condensation is carried out at 220° C. for 6 hours under an atmosphere of reduced pressure to obtain crystalline polyester resins (a) to (c).

TABLE 3

| | | Resin (a) | Resin (b) | Resin (c) |
|---|---|---|---|---|
| Acid component (mol %) | Dimethyl dodecanedioate | 51 | 52 | — |
| | Dimethyl terephthalate | — | — | 52 |
| Alcohol component (mol %) | 1,6-Hexanediol | — | 48 | — |
| | 1,9-Nonanediol | 49 | — | 48 |
| Catalyst (mol %) | Dibutyltin oxide | 0.05 | 0.05 | 0.05 |

Subsequently, 80 parts of each of these crystalline polyester resins (a) to (c) and 720 parts of deionized water are respectively placed in a stainless beaker and the stainless beaker is placed in a warmed water bath and heated at 98° C. At the time of the crystalline polyester resin being melted, stirring is performed at 7000 rpm using a homogenizer (ULTRA-TURRAX T50, manufactured by IKA). Then, emulsion dispersion is carried out while 1.8 parts of an anionic surfactant (NEOGEN RK, solid content: 20%, manufactured by Dai-ichi Kogyo Seiyaku Co., Ltd.) being dropwise added, thereby to obtain crystalline polyester resins (a) to (c) (solid content: 10%).

The molecular weights and melting temperatures (Tm) of the resulting crystalline polyester resins (a) to (c), and the volume average particle sizes in the resin dispersions using these polyester resins are shown in Table 4.

TABLE 2

| | | Resin (1) | Resin (2) | Resin (3) | Resin (4) | Resin (5) | Resin (6) | Resin (7) | Resin (8) | Resin (9) | Resin (10) |
|---|---|---|---|---|---|---|---|---|---|---|---|
| Resin | Weight average molecular weight | 47000 | 32000 | 51000 | 39000 | 17000 | 14000 | 12000 | 11000 | 9500 | 12000 |
| | Tg (° C.) | 55.3 | 58.4 | 57.3 | 61.0 | 60.5 | 58.9 | 57.3 | 56.1 | 60.1 | 57.8 |
| Resin dispersion | Volume average particle size (μm) | 0.148 | 0.140 | 0.162 | 0.151 | 0.138 | 0.162 | 0.158 | 0.143 | 0.147 | 0.161 |

TABLE 4

| | | Resin (a) | Resin (b) | Resin (c) |
|---|---|---|---|---|
| Resin | Weight average molecular weight | 54200 | 19000 | 20500 |
| | Melting point (° C.) | 75.3 | 72.6 | 92.5 |
| Resin dispersion | Volume average particle size (μm) | 0.165 | 0.179 | 0.138 |

(Colorant Dispersion)

Cyan pigment (Pigment Blue 15:3, copper phthalocyanine, manufactured by Dainichiseika Color & Chemicals Mfg. Co., Ltd.): 1000 parts Anionic surfactant (NEOGEN RK, manufactured by Dai-Ichi Kogyo Seiyaku Co. Ltd.): 150 parts Ion-exchange water: 9000 parts The above components are mixed, dissolved, and dispersed for about 1 hour with a high pressure impact disperser (Ultimizer HJP30006, manufactured by Sugino Machine Limited).

The volume average particle size D50 of the colorant particles of the colorant in the colorant dispersion is 0.135 μm, and the colorant concentration is 23%.

(Releasing Agent Dispersion)

Paraffin wax HNP-9 (melting point: 72° C., manufactured by Nippon Seiro Co., Ltd.): 45 parts Anionic surfactant (NEOGEN RK, manufactured by Dai-Ichi Kogyo Seiyaku Co., Ltd.): 5 parts Ion-exchange water: 200 parts The above materials are heated at 95° C., dispersed using a homogenizer (ULTRA-TURRAX T50, manufactured by IKA), and further dispersed with a pressure jetted type of Gaulin homogenizer (Gaulin) to prepare a releasing agent dispersion (the concentration of the releasing agent: 20%) wherein the releasing agent having a volume average particle size of 210 nm is dispersed.

Example 1

Production of Toner

Non-crystalline resin dispersion (1): 120 parts

Non-crystalline resin dispersion (5): 120 parts

Crystalline resin dispersion (a): 70 parts

The above dispersions are mixed and dispersed in a round stainless flask using a homogenizer (ULTRA-TURRAX T50, manufactured by IKA). To this dispersion, polyaluminum chloride (0.15 part) is added, and dispersion formation is continued using the ULTRA-TURRAX. Thereafter;

Colorant dispersion: 22 parts

Releasing agent dispersion: 50 parts are additionally added, and polyaluminum chloride (0.05 part) is further added, followed by continuing dispersion formation using the ULTRA-TURRAX.

A stirrer and a mantle heater are set up and the temperature is raised to 50° C. at a rate of 0.5° C./min while rotation being adjusted so that a slurry may be sufficiently stirred. After the slurry is kept at 50° C. for 15 minutes, the temperature is raised at a rate of 0.05° C./min, and the particle size is determined by COULTER MULTISIZER TYPE II (aperture diameter of 50 μm, manufactured by Beckman, Coulter Inc.) at every 10 minutes. At the time of reaching a volume average particle size of 50 μm, a non-crystalline resin dispersion (1) 75 parts and a non-crystalline resin dispersion (5) 75 parts (additional resin) are added over a period of 3 minutes. The mixture is kept for 30 minutes after the addition, and adjusted to pH 9.0 with a 5% aqueous sodium hydroxide solution. Thereafter, the temperature is raised to 96° C. at a rate of the temperature rising of 1° C./min while the pH is adjusted to 9.0 every 5° C. and the temperature is maintained at 96° C. When the particle shape and surface property are observed by an optical microscope and a Scanning Electron Microscope (FE-SEM) every 30 minutes, a spherical shape is formed in the fifth hour, and the temperature is then lowered to 20° C. at a rate of 1° C./min to solidify the particles.

Thereafter; the reaction product is filtered, washed well with ion exchange water, and dried in a vacuum dryer to give a toner having a volume average particle size of 6.0 μm.

One part of colloidal silica (R972, manufactured by Nippon Aerosil Co., Ltd.) is added to 100 parts of the obtained toner particles, and both are mixed and blended using a HENSHELL mixer to obtain a toner A to which silica is externally added.

(Production of Electrostatic Charge Image Developer)

0.10 Part of carbon black (Trade name: VXC-72, manufactured by Cabot Corp.) is mixed with 1.25 parts of toluene and dispersed with stirring for 30 minutes in a sand mill to give a carbon dispersion. The carbon dispersion is added with a coating resin solution prepared by mixing 1.25 parts of 80 wt % ethyl acetate solution of a trifunctional isocyanate (TAKENATE D110N, manufactured by Takeda Pharmaceutical Company Limited) and Mn—Mg—Sr ferrite particles (an average particle size of 35 μm) in a kneader. The mixture is mixed and stirred at 25° C. for 5 minutes, and the temperature is raised to 150° C. under a normal pressure, followed by removal of the solvent by evaporation. After further mixing and stirring for 30 minutes, power to the heater is turned off to cool down the mixture to 50° C. The resulting coated carrier is sieved with a 75 μm mesh to prepare a carrier.

95 parts of this carrier and 5 parts of the toner A are mixed with a V blender to obtain a developer A.

(Evaluation)

Analysis of Toner Components

Firstly, 100 mg of toner A is poured into 10 ml of acetone, and the mixture is stirred at 25° C. for 30 minutes to obtain a solution in which soluble fractions have been dissolved. The solution is filtered with a membrane filter having an opening of 0.2 μm, and acetone is removed by evaporation to obtain an acetone-soluble fraction.

Next, the acetone-soluble fraction is dissolved in THF, and the solution is served as a sample for GPC determination, and then injected into GPC which has been previously used for the determination of the molecular weight of each resin. On the other hand, a fraction collector is placed at the outlet of the GPC eluate, and eluates are collected every predetermined counts. An eluate corresponding to an area ratio of 10% from the beginning of the elution in the elution curve W1 (the start of the curve) and an eluate corresponding to an area ratio of 20% from the end of the elution in the elution curve W1 are collected, and THF is removed by evaporation to obtain an eluate F(0-10) and an eluate F(80-100), respectively.

Subsequently, a sample 30 mg of each of the eluate F(0-10) and eluate F(80-100) is dissolved in 1 ml of a deuterated chloroform, and tetramethylsilane (TMS) as a standard reference is added thereto at a concentration of 0.05% by volume. The solution is filled into a glass tube of 5 mm diameter for NMR determination, and multiplied 128 times at 23 to 25° C. using a nuclear magnetic resonance spectrometer (JNM-AL400, manufactured by Japan Electron Optics Laboratory Ltd.) to obtain a spectrum.

The monomer composition and the constitution ratio of the resin contained can be determined from the integrated peak ratio in the spectrum obtained. That is, assignment of the peak is performed as shown in the following, and from the respective integrated ratio, the component ratio of the constitution monomers is determined. The peak assignments are determined as follows:

around 8.25 ppm: derived from the benzene ring of trimellitic acid (one hydrogen), around 8.07 to 8.10: ppm derived from the benzene ring of terephthalic acid (four hydrogen atoms), around 7.1 to 7.25 ppm: derived from the benzene ring of bisphenol A (four hydrogen atoms), around 6.8 ppm: derived from the benzene ring of bisphenol A (four hydrogen atoms) and the double bond of fumaric acid (two hydrogen atoms), around 5.2 to 5.4 ppm: derived from the methine group of bisphenol A propylene oxide adduct (one hydrogen) and the double bond of alkenylsuccinic acid (two hydrogen atoms), around 3.7 to 4.7 ppm: derived from the methylene group of bisphenol A propylene oxide adduct (two hydrogen atoms) and the methylene group of bisphenol A ethylene oxide adduct (four hydrogen atoms), around 1.6 ppm: derived from the methyl group of bisphenol A (six hydrogen atoms), around 0.8 to 0.9 ppm derived from the terminal methyl group of alkenylsuccinic acid (twelve hydrogen atoms).

From these results the amount (mol %) of the aliphatic unsaturated dicarboxylic acid-derived component is calculated relative to the total acids-derived components. The results are summarized in Table 6.

Blocking Resistance

Toner A: 10 g is weighed on a cup made of propylene and left to stand under an atmosphere of 50° C. and 50% RH for 17 hours, and blocking (aggregation) state of the toner is evaluated according to the following criteria.

A: The toner flows smoothly if the cup is inclined.

B: The toner collapses gradually and begins to flow if the cup is being moved.

C: The blocking is generated, and collapses if pierced with a top sharp thing.

D: The blocking is generated, and hardly collapses even if pieced with a top sharp thing.

The results are shown in Table 6.

Property in Actual Machine

The developer A obtained above is set to a developing unit, i.e. a remodeling machine Docu Centre C7550 (the setting temperature in the fixing unit is 160° C.) is manufactured by Fuji Xerox Co., Ltd., and 10000 sheets are continuously printed under an atmosphere of 32° C. and 90% RH.

Image Fogging

Evaluation is performed through visual observation with a loupe (magnitude of 50×) on an area of 1 cm square of the blank paper part in the print image of the first sheet (initial) and the 1000th sheet, and the number of fogged toners is counted. The number of the fogged toners on five arbitrary places was counted according to the above method, and the average value is determined as the number $\alpha$ of the fogged toners. Evaluation is carried out according to the following criteria.

A: $\alpha \leqq 5$ (a level of almost no fogging; no problem)

B: $5 \leqq \alpha 10$ (a level of a slight number of the fogged toners; practically no problem)

C: $10 \leqq \alpha \leqq 30$ (a level of worrying about the fogging visually; problematic)

D: $30 < \alpha$ (a level of worrying about the fogging considerably; problematic)

The results are shown in Table 6.

Evaluation of Staining of the Inside of the Machine

Evaluation on the staining in the machine after printing 10000 sheets of paper is performed visually according to the following criteria.

A: There is no staining in the machine, and the finger is not stained even if the machine is rubbed with the finger (A level of no problem).

B: Although there is no staining in the machine at first glance, the finger is faintly stained if the machine is rubbed with the finger (A level of being acceptable).

C: The color of the toner may be seen as staining. The fingertip is stained with a toner color if the machine is touched with a finger (A level of being unacceptable).

D: Deposition of the toner can be visually observed (A level of being unacceptable).

The results are shown in Table 6.

Examples 2 to 5, Comparative Examples 1 to 4

Toners B to I are obtained by the preparation method of toner particles and treatment with external additives according to Example 1, except that dispersions in Table 5 are each used instead of the dispersion used in the production of the toner in Example 1. Using each of these toners, analysis of toner components and properties in actual machines are evaluated according to Example 1.

The results are summarized in Table 6.

TABLE 5

| | | Toner A | Toner B | Toner C | Toner D | Toner E |
|---|---|---|---|---|---|---|
| Combination | Non-crystalline polyester resin dispersion | Resin dispersion (1) 120 parts | Resin dispersion (2) 50 parts | Resin dispersion (3) 150 parts | Resin dispersion (1) 120 parts | Resin dispersion (1) 50 parts |
| | | Resin dispersion (5) 120 parts | Resin dispersion (6) 200 parts | Resin dispersion (7) 150 parts | Resin dispersion (8) 120 parts | Resin dispersion (6) 225 parts |
| | Crystalline polyester resin dispersion | Resin dispersion (a) 70 parts | Resin dispersion (b) 150 parts | Resin dispersion (a) 150 parts | Resin dispersion (a) 70 parts | Resin dispersion (c) 100 parts |
| | Releasing agent dispersion | 50 parts | 50 parts | 50 parts | 50 parts | 50 parts |
| | Colorant dispersion | 22 parts | 22 parts | 22 parts | 22 parts | 22 parts |
| Additional resin | Non-crystalline polyester resin dispersion | Resin dispersion (1) 75 parts | Resin dispersion (2) 100 parts | Resin dispersion (3) 25 parts | Resin dispersion (1) 75 parts | Resin dispersion (1) 25 parts |
| | | Resin dispersion (5) 75 parts | — | Resin dispersion (7) 25 parts | Resin dispersion (8) 75 parts | Resin dispersion (6) 75 parts |

TABLE 5-continued

| | | Toner F | Toner G | Toner H | Toner I |
|---|---|---|---|---|---|
| Combination | Non-crystalline polyester resin dispersion | Resin dispersion (4) 120 parts<br>Resin dispersion (5) 120 parts | Resin dispersion (4) 120 parts<br>Resin dispersion (9) 175 parts | Resin dispersion (1) 120 parts<br>Resin dispersion (9) 120 parts | Resin dispersion (1) 120 parts<br>Resin dispersion (10) 120 parts |
| | Crystalline polyester resin dispersion | Resin dispersion (a) 70 parts | Resin dispersion (b) 100 parts | Resin dispersion (a) 70 parts | Resin dispersion (a) 70 parts |
| | Releasing agent dispersion | 50 parts | 50 parts | 50 parts | 50 parts |
| | Colorant dispersion | 22 parts | 22 parts | 22 parts | 22 parts |
| Additional resin | Non-crystalline polyester resin dispersion | Resin dispersion (4) 75 parts<br>Resin dispersion (5) 75 parts | Resin dispersion (4) 50 parts<br>Resin dispersion (9) 25 parts | Resin dispersion (1) 75 parts<br>Resin dispersion (9) 75 parts | Resin dispersion (1) 75 parts<br>Resin dispersion (10) 75 parts |

TABLE 6

| | Toner (Developer) | Volume average particle size (μm) of toner | Content of aliphatic unsaturated dicarboxylic acid (mol %) F(0-10) | F(80-100) | Blocking resistance | Image fogging Initial stage | 10,000 sheets printing | Staining in machine |
|---|---|---|---|---|---|---|---|---|
| Example 1 | A | 6.0 | 5.0 | 20.0 | B | A | A | A |
| Example 2 | B | 5.9 | 10.0 | 40.0 | A | A | B | B |
| Example 3 | C | 5.8 | 0 | 60.0 | B | A | B | A |
| Example 4 | D | 5.7 | 5.0 | 40.0 | A | A | B | A |
| Example 5 | E | 6.3 | 5.0 | 40.0 | B | A | B | B |
| Comparative Example 1 | F | 5.9 | 15.0 | 20.0 | B | A | C | C |
| Comparative Example 2 | G | 6.0 | 15.0 | 15.0 | B | C | D | D |
| Comparative Example 3 | H | 6.0 | 5.0 | 15.0 | C | B | D | D |
| Comparative Example 4 | I | 6.1 | 5.0 | 65.0 | C | C | C | D |

From the results as shown in Tables 5 and 6, in the Example using a toner wherein the amount of aliphatic unsaturated dicarboxylic acid-derived component in the components fractionated by GPC of the acetone-soluble fraction satisfies the relation within the specific range, it is found that image fogging due to the unevenness of the toner surface and staining in the machine are inhibited and blocking resistance is also good.

On the other hand, since the amount of aliphatic unsaturated dicarboxylic acid-derived component in the fractionated components in the Comparative Examples does not satisfy the specific relation as mentioned above, the toner surface becomes unevenness and the rigidity is not sufficient, and thus it is believed that image fogging and blocking resistance are worsened.

The foregoing description of the embodiments of the invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practice applications, thereby enabling others skilled in the art to understand invention for various embodiments and with the various modifications as are suited to the particular use contemplated. It is intended that the scope of the invention be defined by the following claims and their equivalents.

What is claimed is:

1. A toner for electrostatic charge image development, comprising a binder resin that includes a non-crystalline polyester resin and a crystalline polyester resin, and a colorant, wherein in a measurement of an acetone-soluble fraction of the toner by gel permeation chromatography, in which W1 represents the total area of an elution curve of the acetone-soluble fraction, F(0-10) represents an eluate corresponding to from the beginning of the elution to 10% elution of W1 over time, and F(80-100) represents an eluate corresponding to from 80% elution to 100% elution of W1 over time, the amount of an aliphatic unsaturated dicarboxylic acid-derived component of the resin contained in the eluate F(0-10) is in the range of from about 0 mol % to about 10 mol % relative to the total amount of the acid-derived components of the resin contained in the eluate F(0-10), and the amount of the aliphatic unsaturated dicarboxylic acid-derived component of the resin contained in the eluate F(80-100) is in the range of from about 20 mol % to about 60 mol % relative to the total amount of the acid-derived components of the resins contained in the eluate F(80-100), and the crystalline polyester resin is an aliphatic crystalline polyester resin that is obtained by reacting a dicarboxylic acid having 10 to 12 carbon atoms with a diol having 4 to 9 carbon atoms.

2. The toner for electrostatic charge image development of claim 1, wherein the amount of the aliphatic unsaturated dicarboxylic acid-derived component of the resin contained in the eluate F(0-10) is in the range of from about 0 mol % to about 9 mol % relative to the total amount of the acid-derived components of the resin contained in the eluate F(0-10), and the amount of the aliphatic unsaturated dicarboxylic acid-derived component of the resin contained in the eluate F(80-100) is in the range of from about 20 mol % to about 50 mol % relative to the total amount of the acid-derived components of the resin contained in the eluate F(80-100).

3. The toner for electrostatic charge image development of claim 1, wherein the aliphatic unsaturated dicarboxylic acid is fumaric acid.

4. The toner for electrostatic charge image development of claim 1, wherein the weight average molecular weight (Mw) of the crystalline polyester resin is in the range of from about 6,000 to about 35,000.

5. The toner for electrostatic charge image development of claim 1, wherein the melting temperature of the crystalline polyester resin is in the range of from about 60° C. to about 120° C.

6. The toner for electrostatic charge image development of claim 1, wherein the non-crystalline polyester resin includes a high molecular weight component resin and a low molecular weight component resin.

7. The toner for electrostatic charge image development of claim 6, wherein the weight average molecular weight Mw of the high molecular weight component resin is in the range of from about 30,000 to about 200,000.

8. The toner for electrostatic charge image development of claim 6, wherein the weight average molecular weight Mw of the low molecular weight component resin is in the range of from about 8,000 to about 25,000.

9. The toner for electrostatic charge image development of claim 1, wherein the non-crystalline polyester resin comprises a component obtained by reacting at least one of an aliphatic unsaturated dicarboxylic acid or an anhydride of an aliphatic unsaturated dicarboxylic acid, at least one of alkenylsuccinic acid or an anhydride of alkenylsuccinic acid, and at least one of trimellitic acid or an anhydride of trimellitic acid.

10. The toner for electrostatic charge image development of claim 1, wherein a shape factor SF1 of the toner is in the range of from about 110 to about 140.

11. The toner for electrostatic charge image development of claim 10, comprising one or more external additives, at least one of the external additives having an average primary particle size in the range of from about 30 nm to about 200 nm.

12. The toner for electrostatic charge image development of claim 1, wherein the amount of the colorant is in the range of from about 1% by weight to about 20% by weight relative to the total amount of the resins contained in the toner.

13. An electrostatic charge image developer, comprising the toner for electrostatic charge image development of claim 1.

14. A toner cartridge containing the toner for electrostatic charge image development of claim 1.

15. A process cartridge provided with a developer holding body that contains the electrostatic charge image developer of claim 13.

* * * * *